US005269414A

United States Patent [19]

D'Hollander

[11] Patent Number: 5,269,414

[45] Date of Patent: Dec. 14, 1993

[54] INTERMEDIATE BULK CONTAINER

[75] Inventor: Olivier J. L. D'Hollander, Limelette, Belgium

[73] Assignee: Dow Corning S.A., Seneffe, Belgium

[21] Appl. No.: 868,898

[22] Filed: Apr. 16, 1992

[30] Foreign Application Priority Data

Apr. 29, 1991 [BE] Belgium ..... 9100392

[51] Int. Cl.[5] ..... B65D 19/00

[52] U.S. Cl. ..... 206/600; 206/386

[58] Field of Search ..... 206/600, 386

[56] References Cited

U.S. PATENT DOCUMENTS

| | | | |
|---|---|---|---|
| 2,720,998 | 10/1955 | Potter . | |
| 4,676,373 | 6/1987 | Schneider | 206/600 |
| 4,715,508 | 12/1987 | Schurch . | |
| 4,917,255 | 4/1990 | Foy . | |
| 5,002,194 | 3/1991 | Nichols | 206/386 |
| 5,029,734 | 7/1991 | Nichols | 206/386 X |
| 5,056,667 | 10/1991 | Coogan | 206/600 |

FOREIGN PATENT DOCUMENTS

| | | | |
|---|---|---|---|
| 1159379 | 12/1983 | Canada | 206/600 |
| 1486443 | 5/1965 | Fed. Rep. of Germany . | |
| 89060598 | 11/1989 | Fed. Rep. of Germany . | |
| 1331060 | 5/1963 | France . | |
| 8911422 | 11/1989 | PCT Int'l Appl. . | |
| 2245883 | 1/1992 | United Kingdom | 206/600 |

*Primary Examiner*—William I. Price

*Attorney, Agent, or Firm*—Robert L. McKellar; Richard I. Gearhart

[57] ABSTRACT

A foldable intermediate bulk container with a preferred capacity of about 1000 liters, capable of being stacked both in its erected position and in its folded position, comprises a rectangular base (10), four walls (21, 22, 23, 24) and a lid (35, 36) which are all interconnected. Each wall is pivotally connected to the base (10), at least three of them at different heights from the support (17) of the base, ascending by at least one wall thickness. It is preferably adapted for liquid or free-flowing powder. The base (10) may incorporate the function of a pallet into the structure of the container and may include means for facilitating emptying the container. The container may use an inner pocket (20) for the liquid or powder.

9 Claims, 6 Drawing Sheets

INTERMEDIATE BULK CONTAINER

Figure 1:
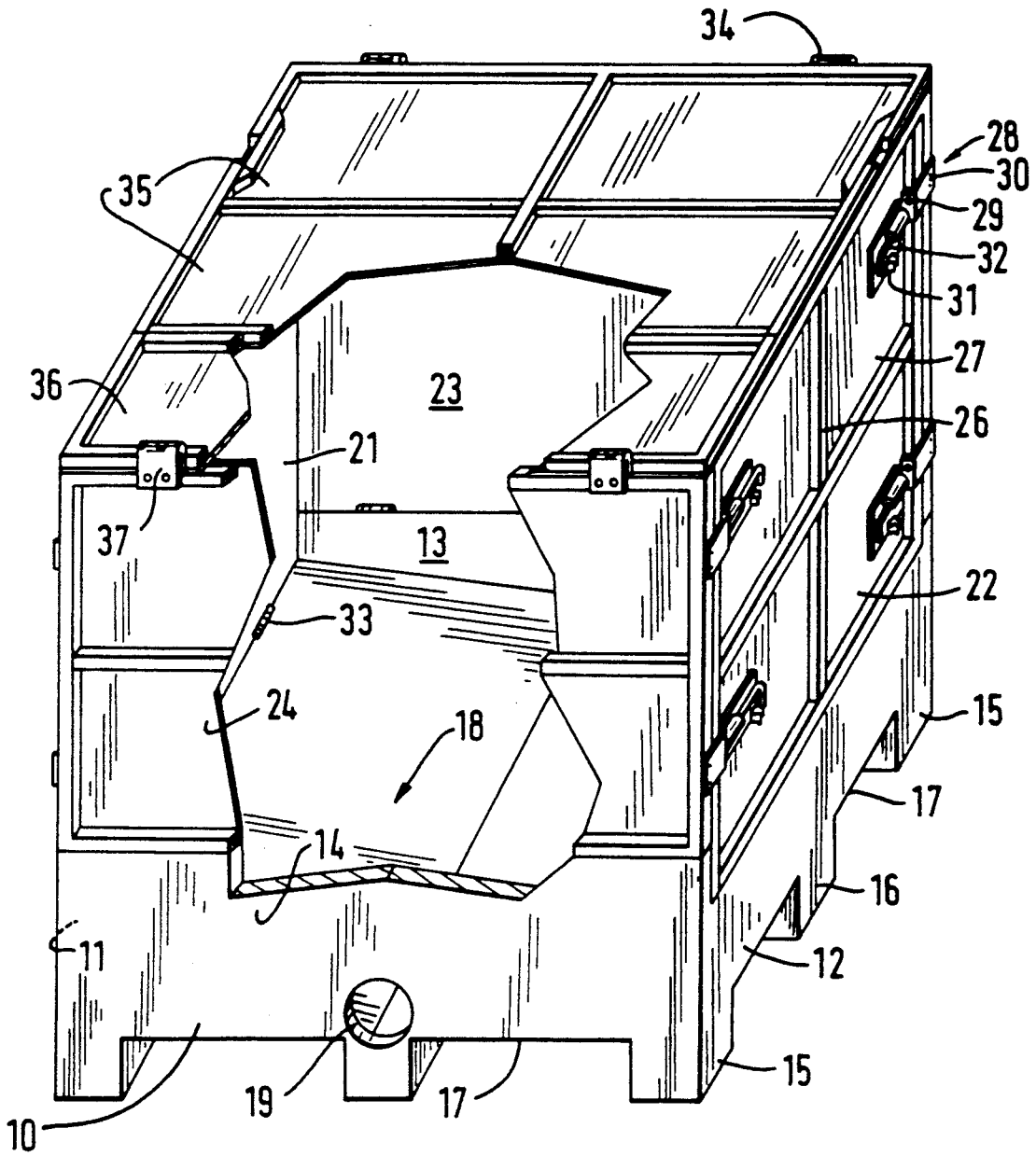

The present invention relates to an intermediate bulk container (IBC). More particularly the present invention relates to a container which is foldable and reusable and which is stackable in the erected position as well as in the folded position. The container of the present invention is particularly, but not exclusively suitable for the transport, storage and handling of liquid materials and of free-flowing powder materials. The present invention is also particularly concerned with containers which have a capacity of at least 50 liters and no more than about 5000 liters.

Containers for storing and transporting liquid or powder materials have been known for a long time. Conventional containers include barrels, drums and cubic or parallelepipedic containers. Cylindrical barrels or drums, many of which have a volume of about 200 liters, are good for storing smaller quantities of liquid material. Where larger quantities are required, they need to be stacked. Drums may be stood upright, but more conveniently are laid down in rows and prevented from rolling by wedging them at the end of the row. This method allows limited stacking of the drums, thus forming a type of pyramid structure. Such stacking methods have obvious drawbacks and risks, not least the collapse of the pyramid structure by the mere dislodging of one of the wedges. With the introduction of pallets and fork lift trucks the stacking of cylindrical drums in an upright manner was made possible by placing a number of pallets, each containing several drums, on top of each other. This method is safer, but still requires great care and skill from the fork lift operator and does not give a very stable system.

A more easily stackable container is a larger mainly cubic container, which allows safer stacking to greater heights, especially when the containers are mounted on pallets.

However, stacking is only one aspect in considering the usefulness of containers. Other important aspects include ease of handling, ease and safety of disposal, reusability, ease of cleaning, transportability and cost.

In many cases drums are regarded as disposable containers, which gives rise to considerable economic and ecological wastage. Reuse of the drums, though ecologically more acceptable, brings other problems with it. Complete emptying and cleaning often is very complex and may require expensive or bulky machinery. Transportation of the empty containers for reuse requires handling the same volume as transportation of full containers, thus making it economically unattractive to do so. The use of larger containers, especially those which consist of a metal shell in which an inner pocket is placed to contain the material which is to be transported or stored, may ease the reusability of the container. This may be due to ease of access for cleaning the inside of the container or to the method of replacing the inner pocket, especially where such pocket is made from a flexible material. Such containers however do not solve the problem of transport as they still have the same volume whether full or empty.

Reusable intermediate bulk containers (IBCs) which are foldable have been suggested in a number of publications. Several such containers are available on the market. European Patent Specification E.P. 263 153 describes a container composed of a base in the form of a pallet, four loose walls and a lid, which are assembled together. After delivery and emptying of the container, all walls and the lid are disassembled and stacked on the pallet. Several of these disassembled units may then be stacked on top of each other. Thus the volume for transport of the empty container is reduced to one quarter or one third of the volume of an erected container. This system has the disadvantage that there is a real risk of losing, misusing or mixing up the components of the container, and thus losing a complete container for the sake of one component. Furthermore assembly, dismantling and sorting of the separate components requires a considerable amount of time and physical effort. Handling several heavy components also involves some safety risks.

A number of patent publications have suggested containers where all parts are connected to each other, in order to avoid some of the above mentioned problems. French Patent Specification FR 1,331,060 describes a rectangular foldable container, which has a pallet-like base with two beams on the longitudinal sides, which come higher than the base surface. When collapsing the container each side wall folds flat onto the base, one half of the lid folds back onto each of the longitudinal walls, which in turn fold down on top of the folded side walls. In order to ensure folding is possible, the patent states that it is imperative that the length of the container is twice its height, that the height of the container is at least half the width of the lid and that the width of the container is twice half the width of the lid. The restrictions of the ratio of the different dimensions of the container are limiting its usefulness. Also, upon folding of the container, the longitudinal walls do not lie parallel to the base, but at least one of them is at an angle thereto. This makes stacking more difficult and reduces the safety and strength of the container when folded.

U.S. Pat. No. 4,177,907 relates to a shipping container wherein all parts are connected together to make the container foldable. The folding mechanism here requires the folding of the endwalls and the roof inwardly against one of the sidewalls, which is then collapsed onto the base. This container is stated to require a crane for most of the folding maneuvers. It has dimensions far beyond those of the containers of the present invention. The containers described still have the restriction that the width of the endwalls must not be greater than half the length of the sidewalls in order to allow folding to take place. There is a need for a collapsible container which is not restricted in such way, and which is easily manageable by one or two people.

An additional short fall of existing containers is the difficulty of emptying them completely, especially when liquid or flowable powder material has been stored or transported. Usually these containers are emptied by being lifted up from the side which is opposite the side with the outlet orifice, for which in some cases, for example in the case of the shipping containers descried in U.S. Pat. No. 4,177,907 a crane is required for this action. Alternatively the containers are arranged on a special trestle allowing them to be tilted. In view of the weight involved, such lifting is cumbersome and may cause a safety hazard.

According to the present invention there is provided a foldable container having a capacity of from 50 to 5000 liters, which is capable of being stacked both in its erected position and in its folded position, said container comprising a rectangular base, four walls and a lid which are all interconnected, characterized in that the base has four sides and a support and has raised portions along at least two of its sides, in that each wall is pivotally connected to the base, at least three of the walls being connected at differing heights from the support of the base, said heights ascending by at least one wall thickness, in that each connection has a pivot axis to allow the walls to be pivoted from a position perpendicular to the support of the rectangular base to a position parallel to said support, in that in the erected position the combined height of each wall with the side of the base to which said wall is connected is substantially the same and in that the lid or each separate part thereof is pivotally connected to a wall, allowing the lid or each portion thereof to be pivoted from its covering position to a position parallel to the wall to which it is connected.

The present invention relates to an intermediate bulk container (IBC), which is useful for the storage, handling and transportation of any material. A container according to the present invention is particularly suitable for the transportation, handling and storage of liquid or flowable materials. A container according to the invention has rigid parts, which may be used in combination with a flexible inner pocket if desired. Preferably the container has a capacity of from 200 to 3000 liters, more preferably of about 1000 liters. The preferred container has a capacity which is slightly more than 1000 liters, for example 1010 to 1060 liters, which makes it easier to fill the container with the required volume of material. Such preferred containers are approximately cubic in shape.

A container according to the invention is stackable in both its erected position and in its folded position. It is reusable and when folded is reduced substantially in volume, making the return of the container more economically attractive, as well as reducing the warehouse space required to store empty containers. All the parts of the container which form a rigid outer casing are interconnected. The parts may be articulated by means of hinges, such that the container may be safely, easily and quickly folded down onto the base and re-erected without risk of losing or exchanging parts. The articulation allows the walls to be erected and supported in a position perpendicular to the surface or top of the base, and closed with a lid when the container is intended for transporting a material. It also allows the folding of the container onto the base when the container is empty and intended for return. In general, a folded container according to the invention will only take up from 20 to 35% of the volume of an erected container. Typically folding the container of the invention reduces its volume to one quarter or one third of the volume when the container is erected.

The base of the container according to the invention comprises four sides and a support. The support is bordered by the four sides, and preferably integral with them. The lower surface of the support may be adapted to rest on a pallet and may conform to the dimensions of a pallet. Preferably however, the base itself comprises supports, for example feet at the corners and possibly in the middle of each side. In this way the base incorporates the function of a pallet into its structure and hence into the structure of the container. In this case, the support of the base acts as a pallet surface as well as the supporting internal bottom surface of the container on which the contents of the container will come to rest. A double support construction is also possible in which a first support surface acts as pallet surface and a second support surface placed above the first one will act as the internal bottom surface of the container. Such incorporation of the pallet shape into the container allows for the insertion of the forks of a fork lift truck. This eases the handling and stacking of the containers. For the purpose of strengthening the container, when a pallet is incorporated into the base, it is preferred that a pallet surface be provided level with the height of the feet of the pallet. Thus it provides a lifting support, enabling the forks of the fork lift truck to lift the container safely. This pallet surface may be integrated with a thicker and shaped base of which the upper surface may provide the internal bottom of the container.

The raised portions of the rectangular base are located at the sides of the base, extending said sides upwards. They allow the hinging of at least three of the four walls at a different height from the pallet surface of the base, each height ascending by at least the thickness of one wall. Where the dimensions of the container are such that the surface area of the base is less than the combined surface area of any pair of two opposite walls, a minimum of three raised portions of differing heights are required on the base in order to allow the folding of all four walls. The wall which is hinged at the lowest height, may be hinged directly to the base at the level of the pallet surface of the base itself, thus not requiring a raised portion. Alternatively each side of the rectangular base may have a raised portion of differing height, and each wall is hinged onto the portion of their respective side at the appropriate height. Most preferably the raised portions have the appropriate dimensions to have the walls hinged to their uppermost edge, i.e. to the edge which is parallel to the pallet surface of the base, and furthest removed from said surface. The difference in height between the places where each wall is hinged to the base corresponds to at least one thickness of the walls of the container. This allows for the walls to be folded down one on top of the other and to be parallel to the pallet surface of the base. The presence of the raised portions of the sides has an additional benefit. Labelling for the container may be placed on said portions, making it visible both when the container is erected and when it is folded.

In an example a first side of the base is at the height of the pallet surface, which allows the wall which is hinged to it, to be folded down onto said pallet surface. In this example it is assumed that the pallet surface and the inner bottom surface are the same. A second side, e.g. the one opposite the first side, has a raised portion which is equal to the thickness of a wall, which allows the wall hinged to the second side to be folded down on top of the first wall. The raised portion of a third side is higher again by the thickness of a wall than the raised portion of the second side, thus enabling the third wall to be folded down on top of the second wall. For this example we will assuming that the lid is in two portions, one portion being hinged onto the third wall, and the other portion onto the fourth wall. A first portion of the lid, which is hinged onto said third wall, is then folded back on top of said wall also. The raised portion of the fourth side of the base will then be higher than the raised portion of the third side by the combined thickness of a wall and the lid. The fourth wall, together with the second portion of the lid, is then folded on top of the first portion of the lid, thus forming a cover for the folded container. It will be obvious to the person skilled in the art that instead of folding down the walls of the container in pairs of opposites (e.g. first left and right, then front and rear), as described above, it is equally feasible to design a structure which allows them to be folded down in a clockwise or anti-clockwise order, or indeed in any order which may be desired.

It is preferred that the rectangular base of the container according to the invention includes means for facilitating the emptying of the container, especially where liquid or freely flowing powder materials are stored in the container. Such means comprises a sloping surface, which will encourage the liquid or powder towards an outlet orifice. The sloping surface will form the internal bottom surface of the container on which the contents will rest. This internal bottom surface may be in addition to the above described pallet surface of the base or may act as both. Preferably a thicker shaped section is used, of which the underneath forms the pallet surface and the upper side forms the internal bottom surface. The lowest part of the slope, when in normal operating position, will be in close proximity to an outlet orifice, thus using the force of gravity to enable complete emptying of the container without having to use tilting action or expensive and elaborate extra equipment and methods. The outlet orifice of the container may be situated for example in one of the raised portions of the sides of the rectangular base. Alternatively, the outlet orifice may be situated in the sloping surface of the base itself, similar in concept to the plug hole of a shower base. The slope may be steady, gradual or irregular. The use of a sloping surface will be equally advantageous when an inner pocket is used inside the rigid container. The outlet orifice may be adapted to be fitted with a dispensing gate, e.g. a tap.

The rectangular base, which is suitably in the form of a pallet, is preferably of standard pallet dimensions. For a container with a capacity of about 1000 liters, the sides of the base would be of from about 1000 to 1200 mm each, thus giving the base a square of for example 1000 mm $\times$1000 mm or a rectangular surface of for example 1000 mm $\times$1200 mm.

The walls of the container are hinged to the base at different heights from the pallet surface of the base, as explained above. It will be clear therefore that the walls themselves will have different heights, such that the combined height of the wall with the height of the side of the base to which the wall is hinged is the same for each side of the container, thus resulting in a level top of the container, onto which the lid may bear. Where the container is to have a capacity of about 1000 liters, the height of the container will be of from about 950 to 1200 mm, typically 1050 mm. Where increased access is required to the inside of the container, for example for placing a flexible pocket inside the container, one of the walls may consist of two hinged parts, arranged in a way to allow outward pivoting of the upper part. The upper part of the wall, which may comprise any portion of that wall, but typically will comprise from one quarter to one half of that wall, may then be folded back onto the remaining lower part of the wall to give greater access to the internal area of the container.

The lid may be made of one part, but more preferably the lid is divided into two portions, each portion being hinged onto a different wall. The hinge will be on the uppermost edge of said wall (i.e. opposite to the edge whereby the wall is hinged to the base). Most suitably the different walls to which the different portions of the lid are hinged are opposite walls of the container. Making the lid into more than one portion makes it easier to fold the container and to avoid some parts of the folded container from hanging over the edge of the rectangular base. Each portion of the lid may be pivoted from the position of covering the container to a position of being parallel to the wall to which it is hinged, i.e. folded back against said wall.

Preferably the portion of the lid is pivoted outwardly so that it comes to rest against the wall to which it is hinged. This would allow access to the contents of the container, for example to insert a pocket, fill or empty the container or to inspect the materials stored. Preferably the portions of the lid are unequal in size. They are preferably rectangular, each having a different length. Suitably the length of each portion is chosen such that the combined length of the wall which will form the uppermost part of the folded container and the portion of the lid which is hinged thereon, is substantially equal to the length of the rectangular base. In this way the folded container will have an uppermost part which covers the same surface area as the rectangular base. The dimensions of the wall extended with that portion of the lid thus reconstitute the surface of the whole lid for the folded container, which is also substantially equal to the surface of the rectangular base. By providing said cover to the folded container, the stacking of folded containers is facilitated and the folded container itself is better protected against accidental damage. The cover thus formed, may be provided with slightly indented areas to improve the stability of stacking another container on top of the first one. Other methods, e.g. slightly raised edges around the area where the feet of the next container will be located, may also be used for this same purpose.

The rigid casing or the container may be made in any of the conventional known materials. Such materials include metal, wood and hard plastics. Particularly preferred are aluminium, mild steel, galvanised steel or stainless steel. It may be made by forming a tubular frame. Additionally the tubular frame may be strengthened by attaching to it a metal plate. Alternatively the container may be made from plastic, moulded or cast in the appropriate shape.

Hinges which are used to link the walls to the base may be two-directional or one-directional hinges. The latter are preferred, as they will allow the walls to be pivoted inwardly onto the base, but not outwardly. This will ease the erection of the container as each wall may then be pivoted to a substantially perpendicular position in relation to the pallet surface of the base, where it can be left unattended without the danger of the wall falling outwardly, while the other walls are erected prior to securing all the walls together. Hinges which are useful for the lid or lid portions are preferably such that they allow the lid to be pivoted over more than 90°. Hinges which are appropriate are well known and commercially available. It will be obvious to a person skilled in the art which hinges are most suitable for the different types of construction material.

The walls have incorporated a means of securing them together in the erected position. Such means are well known and include catches, latches, sliding bolts, clips, levers, hooks, clamps or other locking systems. Optionally a securing means for the lid may also be provided, as may a securing means for the parts when the container has been folded.

A more preferred container according to the invention, having a capacity of about 1000 liters, will have an overall size which renders it suitable for stacking in standard equipment. For example a dimension of 1000 mm $\times$1200 mm $\times$1050 mm allows the transport of containers in rows of 2 side by side and stacked two high in standard lorries having a dimension of 2400 mm wide and 2400 mm high. Standard ISO containers being 2300 mm wide and 2300 mm high and 5800 mm long can easily be loaded with 20 full containers of this size. On return, these lorries will handle 3 to 4 times as many containers.

When the container is used for the transportation and storage of liquid materials or small freely flowable materials, it is important to provide means of containing said material inside the container. This may be achieved by sealing the areas where the components of the folding container meet, for example by the use of sealing strips on the edges of each wall. More preferably however, a pocket may be inserted into the container, which is suitable for being filled with the liquid of flowable material. Such pockets are known in the art and are commercially available. The pocket may be flexible, rigid or semi-rigid and has a shape which is close to the internal shape of the container. The pocket may be discarded after use or refilled, if necessary after cleaning. The inner pocket has at least one opening, which may be used for filling and/or emptying the pocket. More preferably a separate opening or inlet and outlet gate are provided. The inlet or filling gate is located near the side of the pocket which is uppermost when inserted into the container, i.e. the side which is furthest removed from the rectangular base. A suitable inlet gate consists of a threaded opening sealed with a screw-in or screw-on cap. An outlet or emptying gate is located lower down, preferably at the lowest point of the container when in normal use. Filling and emptying the container may then be achieved in conventional ways by using the inlet and outlet gates. A sealed outlet gate may be provided, which will avoid the spilling of any contents when a dispensing gate is fixed to said outlet gate. Such systems are well known in the art. Often a dispensing gate will comprise a cutting means for removal of the seal after the dispensing gate has been fixed to the outlet gate.

The inner pocket may be rigid, semi-rigid or flexible and may comprise one or more layers of plastic or other material. The pocket may be made of extruded high density polyethylene inflated without a seam. For the transport and storage of materials which are insensitive to oxygen, the pocket may consist of e.g. 3 laminated layers of different thickness of low-density polyethylene with a variable amount of polyethylene vinyl acetate. For the transport of materials which are sensitive to oxidation or radiation, appropriate materials, known in the art may be used, for example 2 or 3 laminated layers of polyethylene in combination with 2 or 1 layer of a metal-coated polyester or of a polyvinylidene chloride. An aluminium foil may also be included among the films of plastic material forming a barrier to all manner of agents which risk degrading the content. Preferably the inner pocket is flexible and made of low-density polyethylene, for example in three layers of about 80 $\mu$ each.

The pocket may be placed inside the container prior to filling. This may be done during the erection of the container, or after the container has been erected, by opening e.g. one portion of the lid and sliding the pocket inside. Alternatively one of the walls may have a hinged part, e.g. the upper part of the wall, which may be opened and lowered to enable the operator to have access to the inside of the container for placement of the pocket.

Where an inner pocket has been used, this may be removed from the container prior to folding the container for return transport. In many cases the inner pocket poses a problem of disposal. The container of the present invention in its more preferred form provides a solution. Where the base of the container comprises a sloping internal bottom surface, to encourage the liquid or powder to migrate towards the outlet orifice, an internal cavity is created when the container is folded, between the sloping surface of the base and the first wall which is folded onto the base. This cavity can be used to house the empty inner pocket during return transport of the folded container. Thus the disposal or recycling of the inner pocket raises no concern for the customer of the liquid material, and can be handled by the manufacturer of the material, who in many cases is better equipped to do so.

The invention will now be illustrated by a preferred embodiment of the container, which will be described with reference to the attached drawings in which FIG. 1 gives a perspective view of an empty erected closed container with a section cut away to reveal the inside, showing a sloping internal bottom surface.

Figure 2:
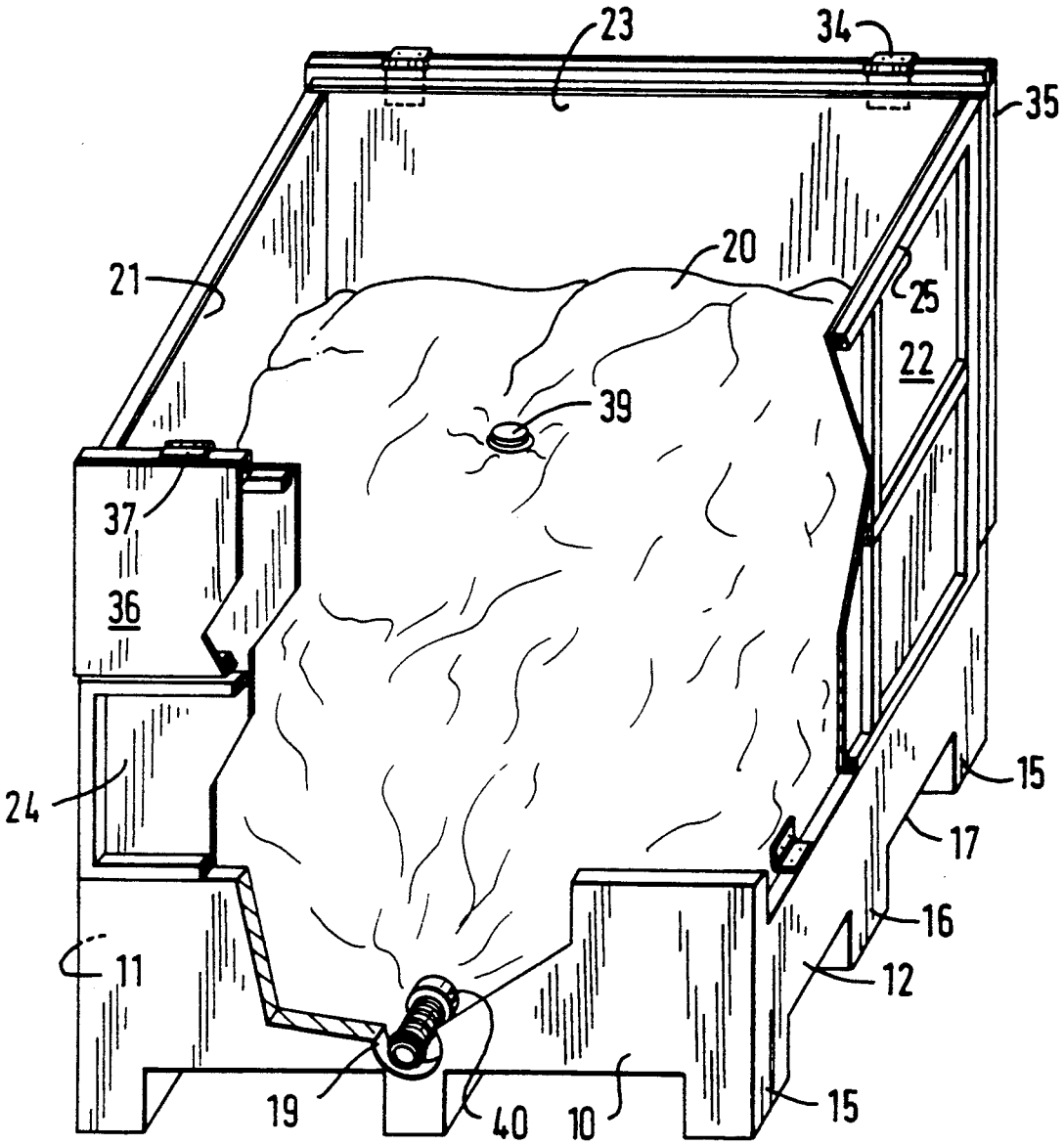

FIG. 2 gives a perspective view of an erected open container with an inner pocket, and a section cut away to reveal the inside view, showing the inner pocket.

Figure 3:
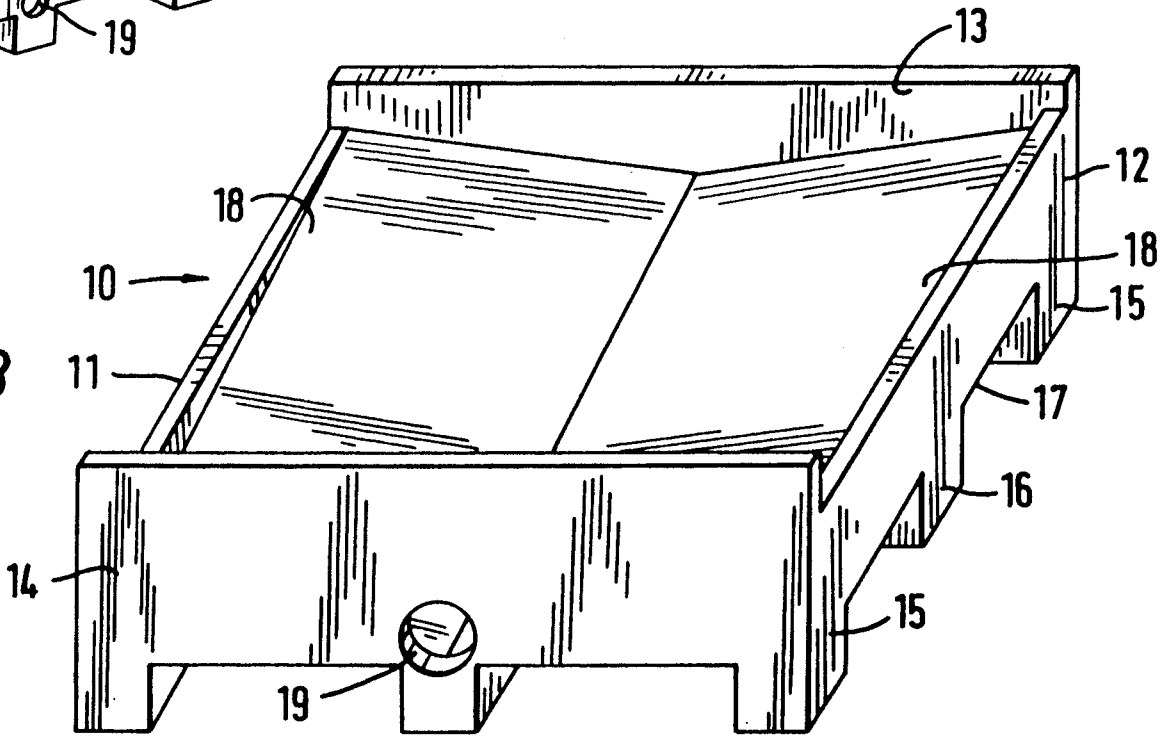

FIG. 3 gives a perspective view of the rectangular base showing the sloping internal bottom surface, the raised portions of the side and an outlet orifice.

Figure 4:
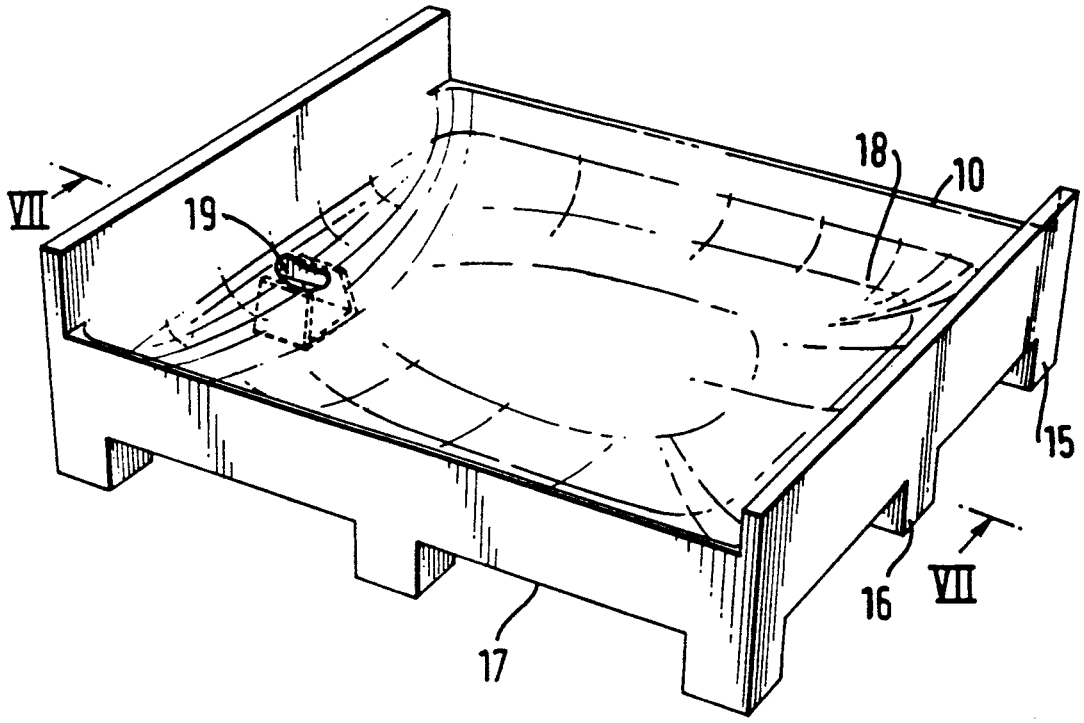

FIG. 4 gives a perspective view of the rectangular base showing an alternative form of a sloping internal bottom surface, the raised portions and an alternative location of an outlet orifice.

Figure 5:
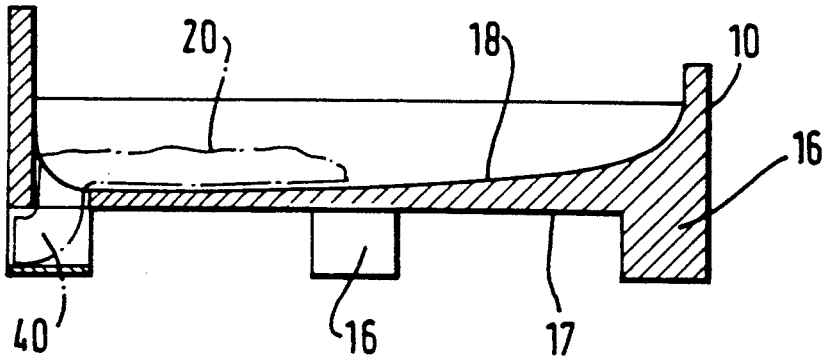

FIG. 5 gives a cross sectional view of the alternative outlet orifice arrangement along the line VII—VII in FIG. 4, having added thereto an inner pocket with outlet gate inside said orifice.

Figure 6:
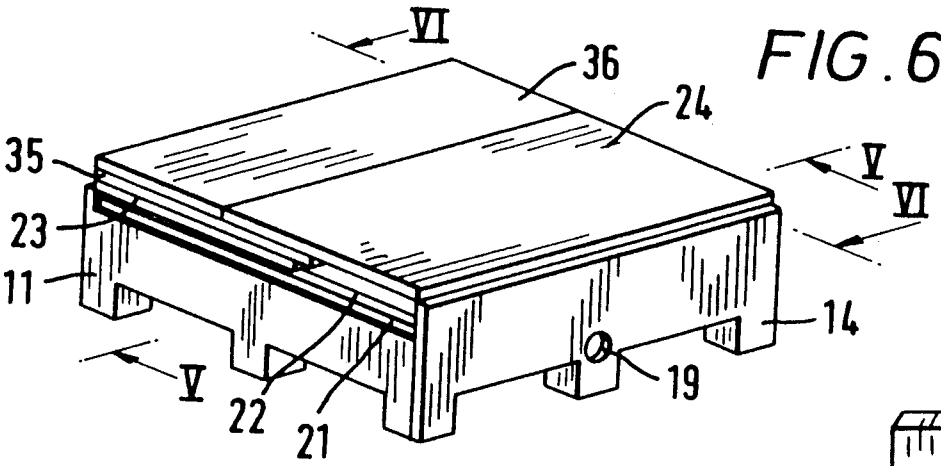

FIG. 6 gives a perspective view of a folded empty container.

Figure 7:
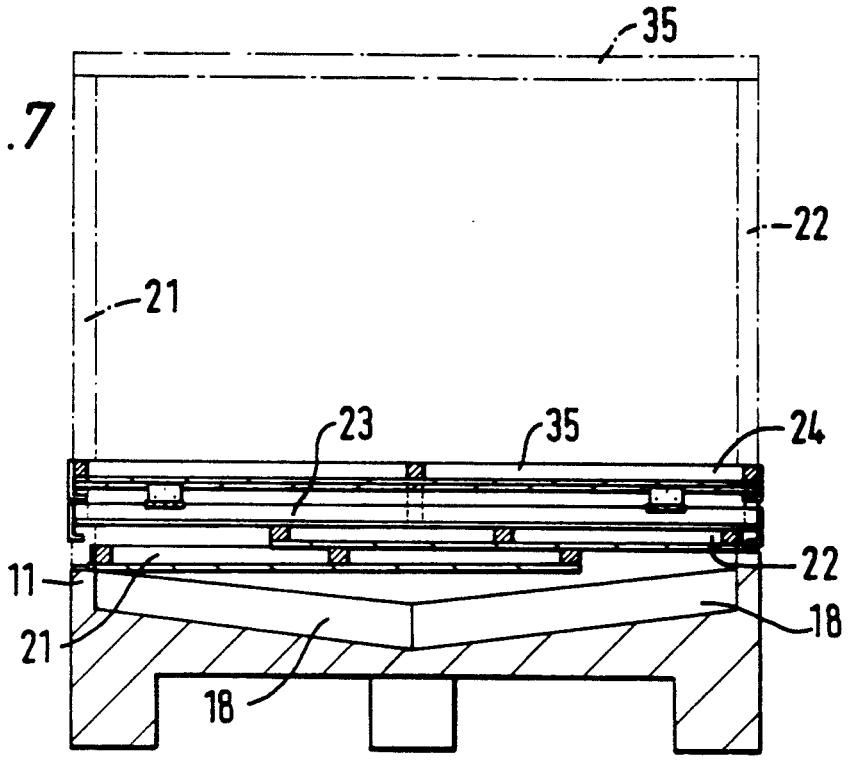

FIG. 7 gives a cross sectional view of the empty folded container along the line V—V of FIG. 6.

Figure 8:
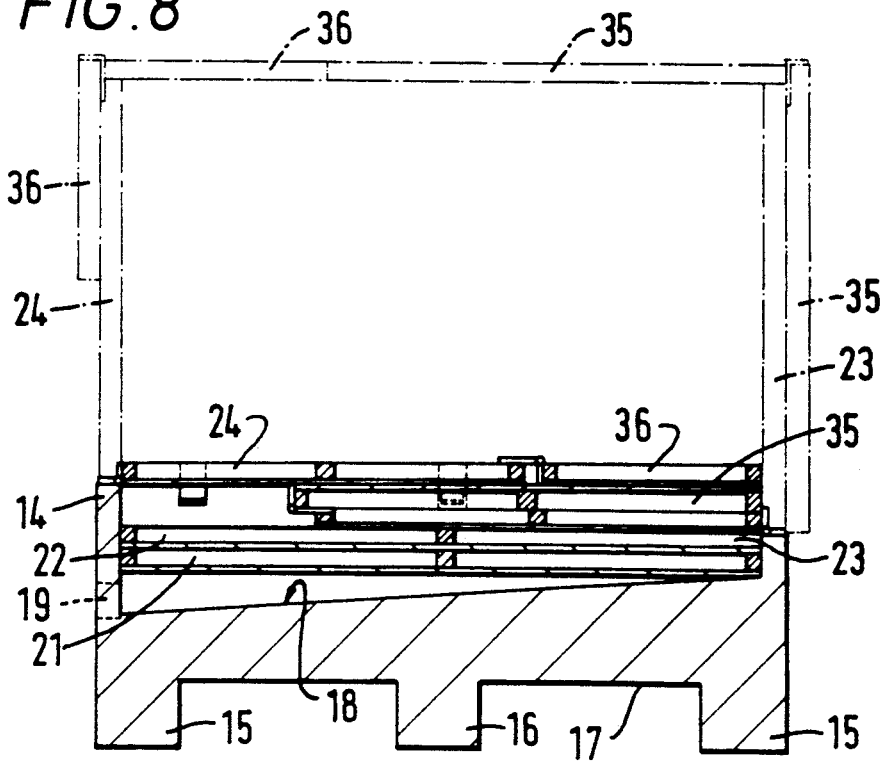

FIG. 8 gives a cross sectional view of the empty folded container along the line VI—VI of FIG. 6.

Figure 9:
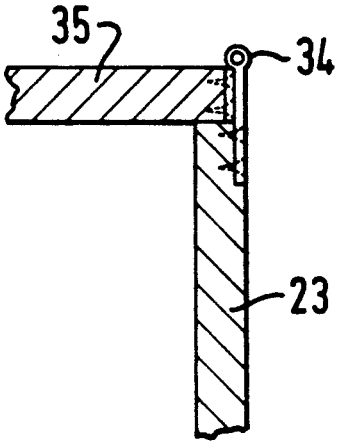

FIG. 9 gives a detail of a hinge arrangement for a portion of the lid, whereby the lid is in the closed position of the erected container.

Figure 10:
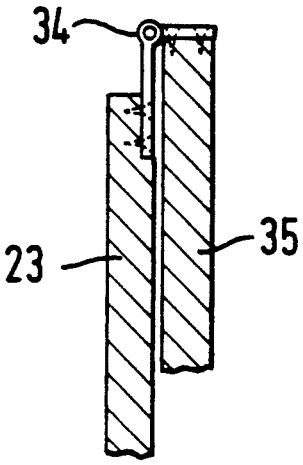

FIG. 10 gives a detail of a hinge arrangement for a portion of the lid, whereby the lid is folded back against the wall to which it is attached.

Figure 11:
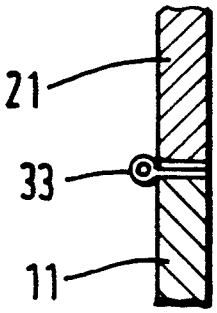

FIG. 11 gives a detail of a hinge arrangement between a wall and the base, whereby the wall is erected.

Figure 12:
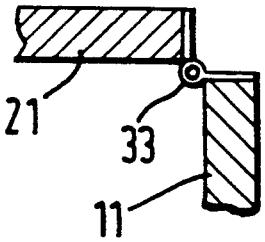

FIG. 12 gives a detail of a hinge arrangement between a wall and the base, whereby the wall is folded onto the base.

The same components of the container are referenced by the same numbers in all drawings.

The rectangular base 10 of the container is in the form of a pallet. It comprises four reinforced, raised sides of equal thickness. As seen in FIG. 1, one side 11 is on the left, one side 12 on the right, one side 13 at the rear and one side 14 at the front of the container. The base has the form of a pallet in that each corner is provided with a foot 15 and in the middle of each side is another foot 16. In an alternative arrangement as shown in FIG. 5, a middle foot 16 performs the additional function of containing and protecting the outlet gate of the inner pocket. Between the feet is located the pallet surface 17 which allows engagement of the forks of a fork lift truck for pallets (not shown).

Bordered by the sides 11, 12, 13, 14, is an inclined internal surface 18, internal to the container. This surface 18 forms the surface area on which the contents of the container will rest. The surface 18 is inclined in the shape of a V from the sides 11 and 12 to a median line, which is parallel to said sides 11 and 12. The median line itself is inclined from the rear 13 to the front 14. Adjacent the lowest point of the internal bottom surface 18 is provided in the front side 14 an outlet orifice 19 which allows access to the outlet gate 40 of a flexible inner pocket 20 (see FIG. 2). Alternatively, as seen in FIG. 4, the sloping internal bottom surface 18 has a more gradual sloping shape, not dissimilar to a shower base. The outlet orifice 19 is in this case provided in the sloping surface 18 itself at the lowest point of the slope when the container is in its normal erected position.

Above the pallet surface 17 and integrated with the sides 11, 12, 13 and 14 are the raised portions of the base 10. Hinged to the sides 11, 12, 13 and 14 are the walls of the container. These walls have a thickness which is similar to the thickness of the sides. They are arranged such that wall 21 is hinged to side 11, wall 22 to side 12, wall 23 to side 13 and wall 24 to side 14. In the erected state, the total height of each side of the base plus the height of the wall which is attached to it, is identical and equal to the height of the open container.

Hinged to at least one wall is the lid 35, 36. In the illustrated embodiment, the lid is in two complementary rectangular parts. A first part 35 is larger than the second part 36, although both parts have the same width. Part 35 of the lid is hinged to the uppermost edge of wall 23 while part 36 is hinged to the uppermost edge of wall 24. The combined length of the two parts of the lid is such that it is substantially equal to the length of the uppermost edge of each of the sidewalls 21 and 22. The lid in its closed position will rest on the uppermost edges of all four walls, thus forming a cover for the container content. A locking mechanism for the parts may be provided if desired.

The construction of the walls and lid, as illustrated in the drawings, consists of a rigid solid frame 25, for example made of metal, e.g. stainless steel and reinforcing crosspieces 26. The frame 25 is covered on the side which is innermost to the container, by a sheet 27, which may be metal, wood, plastic or another suitable material.

In order to maintain the container in its erected position during transport and storage, without allowing the walls from moving inwardly or outwardly, and thus in order to strengthen the whole of the erected container, the upward edges of the walls 23 and 24 are provided with hooks 28, the inwardly turned edges 29 of which prevent outward movements of these walls. These edges bear on the upward edges of the sidewalls 21 and 22, which prevent inward movements of the walls 23 and 24. Walls 21 and 22 are prevented from moving outwardly by the flat portion 30 of the hooks 28 and inwardly by the latches 31, the bolt 32 of which engages in an orifice formed in the inwardly turned portion 29 of the hooks 28. The wall 23 carries on its uppermost edge at least one hinge 34 which articulates and attaches lid portion 35. Hinge 34 allows the lid portion 35 to assume a covering position, bearing on the uppermost edges of walls 21, 22 and 23. The lid can be opened and folded outwardly, coming to rest against the outside of wall 23. A similar construction is used for the portion 36 of the lid, using hinge 37, and bearing on the edges of walls 21, 22 and 24. FIGS. 9 and 10 show a form of hinge 34, 37 which is suitable for the construction. In FIG. 9 the lid is shown in a closed position, while in FIG. 10 the lid is shown in a opened position, giving free access to the contents of the container.

In order to allow folding of the walls for returning the container in a folded position with a reduced volume, each wall is articulated and attached to the corresponding side of the base 10 by means of at least one hinge 33. This hinge may run the whole length of the edges which are to be attached to each other, or as exemplified, may consist of a number of separate hinges. The hinges pivot about an axis which allows the edge of the wall to bear on the corresponding edge of the raised portion of the side of the base, when the wall is erected. The hinges also allow the wall to be pivoted towards the interior of the container to a position parallel with the base.

In order to enable the positioning of the walls on top of each other in the folded position, the raised portions of the sides 11, 12, 13 and 14 of the base 10 have heights which are different. The difference in height between the raised sides is at least one thickness of a wall. In the illustrated embodiment, wall 21 is intended to be folded down first. For this reason the side 11 is slightly higher than the uppermost part of the inclined internal bottom surface 18. Wall 22 is intended to be the next one to be folded down on top of the folded wall 21. The raised portion of side 12 is accordingly higher than side 11 by at least the thickness of wall 21. This allows wall 22 to be folded on top of wall 21, being parallel therewith. Rear wall 23 is intended to be folded down as the third wall, coming to rest on top of the folded wall 22. Firstly however, lid portion 35 is folded back against the wall 23. The combined wall and lid portion, 23 and 35 is then folded down so that wall 23 comes to rest on top of wall 22, and lid portion 35 comes to rest on top of wall 23. In order to achieve this, the raised portion of side 13 is accordingly higher than side 12 by at least the thickness of wall 22. Front wall 24 is the last to be folded on top of wall 23. Wall 24 has attached to it the smaller part 36 of the lid. This lid portion is folded back onto the outside of wall 24, followed by folding the combined wall and lid portion 24 and 36 on top of wall 23. In order to achieve this, the raised portion of side 14 must be higher than that of portion 13 by at least the thickness of wall 23 and the thickness of lid portion 35 combined. When wall and lid portion 24 and 36 have been folded down, lid portion 36 is then folded back in extension of wall portion 24. Together wall 24 and lid portion 36 thus form a cover for the folded container, onto which a next container can be stacked. The size of lid portion 36 was chosen thus to enable the formation of this cover.

The folded container has a reduced volume, which is ready for returning, and in which all parts are folded, while remaining attached to each other, without the risk of losing or exchanging parts. Erection of the container is easily carried out by reversing the actions described above.

An inner pocket 20 may be used to enable storage and transport of liquid or powder materials in an more convenient way. It is made of a plastic material, is provided with an inlet gate 39 and and outlet gate 40. These gates can be closed by means of suitable seals, for example screw-in plug. The pocket has a shape close to the internal shape of the container when filled. The outlet gate may be adapted to be connected to a dispensing gate for emptying the container. The pocket may be placed inside the container in such a way that the outlet gate is located opposite or placed inside the orifice 19, e g in the raised portion of side 14 of the base, as illustrated in FIG. 1, or in the sloped base 18, as illustrated in FIGS. 4 and 5. In the latter illustration, the outlet gate comes to be located inside the hollow middle foot 16, which thus protects the outlet gate against accidental damage, for example by the forks of a fork lift truck.

That which is claimed is:

1. A foldable container having a flexible inner pocket adapted for the storage and transport of a liquid or free flowing powder material, said container capable of being stacked both in its erected position and in its folded position, said container comprising a rectangular base, four walls and a lid which are all inter-connected, the base (10) having four sides (11, 12, 13, 14) and a support (17), and having raised portions along at least two of the sides of the base, each wall (21, 22, 23, 24) being pivotally connected to the base (10). at least three of the walls being connected at differing heights from the support (17) of the base (10), said heights ascending by at least one wall thickness, each connection (33) having a pivot axis to allow the walls (21, 22, 23, 24) to be pivoted from a position perpendicular to the support (17) of the rectangular base (10) to a position parallel to said support (17), the combined height in the erected position of each wall (21, 22, 23, 24) with the side (11, 12, 13, 14) of the base to which said wall is connected being substantially the same, and each wall additionally dimensioned to lay within the area defined by the outer edges of the base when the container is in the folded position, and further, said lid being divided into two parts (35, 36) such that the combined length of the wall (24) which will form the uppermost part of the folded container and the portion (36) of the lid which is hinged thereon, is substantially equal to the length of the rectangular base (10), thus providing a substantially flat cover for the folded container, and said container further including means for facilitating the emptying of the container said facilitation means having a sloping internal bottom surface inclined in the shape of a V from two opposite sides to a median line, parallel to said sides, the median line itself being inclined from a third side of the base to the opposite side.

2. A foldable container according to claim 1 wherein the rectangular base (10) comprises a pallet surface (17) and feet (15, 16) thus incorporating the function of a pallet into the structure of the container.

3. A foldable container according to claim 1 which also includes an outlet orifice (19) incorporated in the rectangular base (10) in the proximity of the lowest point of the sloping internal bottom surface (18).

4. A foldable container according to claim 1 wherein each of the walls (21, 22, 23, 24) is hinged to the base (10) at a different height.

5. A foldable container according to claim 1, wherein each part of the lid (35, 36) is hinged to an opposite wall (23, 24) of the container.

6. A foldable container according to claim 1 wherein the walls (21, 22, 23, 24) are connected to the rectangular base (10) with hinges (33) which will allow the walls to be pivoted from a position which is substantially perpendicular to the support (17) of the rectangular base (10) to a position which is parallel with said support (17), but which will not allow the walls to pivot outwardly.

7. A foldable container according to claim 1 wherein the inner pocket (20) is provided with an inlet gate (39) on the uppermost side of the pocket and an outlet gate (40) in close proximity to the outlet orifice (19).

8. A foldable container according to claim 1 which upon being folded has its volume reduced to from one third to one quarter of the volume of the erected container.

9. A foldable container according to claim 1 wherein a securing means is provided to secure the walls in their erected position.

* * * * *